US011319711B2

(12) United States Patent
Lee et al.

(10) Patent No.: US 11,319,711 B2
(45) Date of Patent: May 3, 2022

(54) METAL INTERIOR MATERIAL AND INTERIOR MATERIAL ATTACHMENT STRUCTURE

(71) Applicant: SAMWON ACT CO., LTD., Busan (KR)

(72) Inventors: Kyung Wook Lee, Ansan-si (KR); Kyung Yul Lee, Bucheon-si (KR); Hong Suk Han, Siheung-si (KR)

( * ) Notice: Subject to any disclaimer, the term of this patent is extended or adjusted under 35 U.S.C. 154(b) by 0 days.

(21) Appl. No.: 16/971,134

(22) PCT Filed: Feb. 21, 2019

(86) PCT No.: PCT/KR2019/002128

§ 371 (c)(1),
(2) Date: Aug. 19, 2020

(87) PCT Pub. No.: WO2019/164295

PCT Pub. Date: Aug. 29, 2019

(65) Prior Publication Data

US 2021/0102381 A1 Apr. 8, 2021

(30) Foreign Application Priority Data

Feb. 22, 2018 (KR) ..... 10-2018-0021336

(51) Int. Cl.

| | |
|---|---|
| ***E04F 13/08*** | (2006.01) |
| ***E04F 13/12*** | (2006.01) |
| ***E04F 15/06*** | (2006.01) |
| ***E04F 15/02*** | (2006.01) |

(52) U.S. Cl.
CPC ..... *E04F 13/0848* (2013.01); *E04F 13/0801* (2013.01); *E04F 13/12* (2013.01); *E04F 15/02* (2013.01); *E04F 15/06* (2013.01)

(58) Field of Classification Search
CPC ..... E04F 13/0848; E04F 13/12; E04F 13/08; E04F 13/0801; E04F 13/083; E04F 15/06; E04F 15/02; E04F 15/02194; E04F 15/02038; E04F 2201/02; E04F 2201/05
See application file for complete search history.

(56) References Cited

U.S. PATENT DOCUMENTS 5,323,575 A * 6/1994 Yeh ..... E04F 21/1844 52/177
5,616,389 A * 4/1997 Blatz ..... A47G 27/0293 404/36
D415,581 S * 10/1999 Bertolini ..... D25/156
(Continued)

FOREIGN PATENT DOCUMENTS

CA 3030481 A1 * 2/2018 ..... E01C 11/222
CN 106760381 A 5/2017
(Continued)

*Primary Examiner* — Jessie T Fonseca
(74) *Attorney, Agent, or Firm* — Quantum Patent Law Firm

(57) ABSTRACT

The present disclosure relates to interior material attachment structure with wall attachment part bolt grooves, including: binding protrusions formed at the outermost part of the interior material attachment structure in order to attach the metal interior material; and connection part grooves formed adjacent to the binding protrusions in order to connect the plurality of interior material attachment structures to each other.

11 Claims, 12 Drawing Sheets

(56) References Cited

U.S. PATENT DOCUMENTS 6,467,224 B1 * 10/2002 Bertolini ..... E04F 15/02194 52/177
D522,149 S * 5/2006 Shin ..... D25/156
D553,264 S * 10/2007 Shin ..... D25/156
8,464,490 B2 * 6/2013 Rapaz ..... E01C 5/001 52/592.1
8,683,769 B2 * 4/2014 Cerny ..... E04F 15/105 52/582.2
9,010,060 B2 * 4/2015 Rapaz ..... E04B 5/026 52/592.1
10,934,722 B2 * 3/2021 Cipriani ..... E04F 15/02405
2002/0152702 A1 * 10/2002 Tseng ..... E04F 15/105 52/403.1
2003/0061772 A1 * 4/2003 Bertolini ..... E04F 15/043 52/177
2003/0177728 A1 * 9/2003 Ku ..... E04F 15/105 52/403.1
2006/0185297 A1 * 8/2006 Mei ..... E04F 15/043 52/506.05
2006/0260223 A1 * 11/2006 Wang ..... E04F 15/087 52/177
2008/0118703 A1 * 5/2008 Sansano Marti . E04F 15/02194 428/119
2008/0276557 A1 * 11/2008 Rapaz ..... E04F 15/105 52/302.3
2009/0266022 A1 * 10/2009 Lin ..... E01C 5/001 52/506.1
2009/0272876 A1 * 11/2009 McNamara ..... E04G 17/02 249/192
2010/0043334 A1 * 2/2010 Rodriguez Alcaine ..... E04F 15/022 52/588.1
2010/0170176 A1 * 7/2010 Sansano Marti ..... E04F 15/105 52/302.1
2010/0257801 A1 * 10/2010 Anderson ..... E04F 15/105 52/391
2010/0263317 A1 * 10/2010 Genova ..... E04F 15/02194 52/588.1
2011/0023389 A1 * 2/2011 Myers ..... F21V 33/006 52/173.1
2011/0113713 A1 * 5/2011 Lui ..... E04F 13/14 52/391
2011/0265411 A1 * 11/2011 Lai ..... E04F 15/02194 52/403.1
2013/0167458 A1 * 7/2013 Cerny ..... E04F 15/02194 52/177
2015/0047286 A1 * 2/2015 Bernat ..... E04F 15/02194 52/588.1
2015/0059271 A1 * 3/2015 Tsai ..... E04F 15/02044 52/302.1
2015/0252563 A1 * 9/2015 Cerny ..... E04F 15/02038 52/588.1
2015/0284965 A1 * 10/2015 Hurson ..... B32B 37/24 52/588.1
2015/0322679 A1 * 11/2015 Vigouroux ..... E04F 13/0837 52/506.05
2019/0117040 A1 * 4/2019 Knight ..... B32B 27/308
2019/0127991 A1 * 5/2019 Santana ..... E04F 15/18

FOREIGN PATENT DOCUMENTS

EP 3231957 A1 * 10/2017 ..... E04F 15/02038
KR 10-1998-057306 A 9/1998
KR 20-0287104 B1 8/2002
KR 20-0368965 B1 12/2004
KR 10-0575093 B1 4/2006
KR 10-0894014 B1 4/2009
KR 20-2009-0003704 A 4/2009
KR 10-0900508 B1 6/2009
KR 10-2011-0019913 A 3/2011

* cited by examiner

METAL INTERIOR MATERIAL AND INTERIOR MATERIAL ATTACHMENT STRUCTURE

TECHNICAL FIELD

The present disclosure relates to a metal interior material attached to an inner wall or ceiling, and an attachment structure for attaching the interior material.

BACKGROUND ART

The related art illustrated in FIG. 12 provides a natural veneer interior material including a natural veneer sheet, non-woven fabric attached to the rear surface of the natural veneer sheet, and a hot melt sheet attached to the rear surface of the non-woven fabric.

The natural veneer interior material includes a natural veneer sheet 10 and a hot melt sheet 30 attached to one surface of the natural veneer sheet 10. Between the natural veneer sheet 10 and the hot melt sheet 30, non-woven fabric 20 may be interposed as illustrated in FIG. 12. The non-woven fabric is attached to a surface of the natural veneer sheet 10 through a typical adhesive, and used to compensate for low strength of the natural veneer sheet. A protection sheet 40 is attached to the rear surface of the hot melt sheet 30. The protection sheet 40 prevents the hot melt sheet 30 from coming into contact with an organic solvent or the like, before distribution or construction. The protection sheet 40 is removed during construction. As the protection sheet, a paper, resin film or the like may be used.

The hot melt sheet 30 is a solid adhesive which exhibits an adhesion property when heat is applied thereto. The hot melt sheet 30 is molten by heat applied during construction, and exhibits an adhesion property. During a cooling process, the hot melt sheet 30 is hardened to maintain an adhesive force.

In order to provide an adhesive force with the natural veneer sheet, some heat may be applied. Then, a protection sheet is attached to the surface of the hot melt sheet. For the attachment between the protection sheet and the hot melt sheet, some adhesive may be applied to the protection sheet. Through such a process, the natural veneer interior material is manufactured.

When the natural veneer internal material is attached to a base material made of aluminum, plastic, stainless steel or a coated steel sheet, the natural veneer interior material may be easily detached. Therefore, after the surface of the base material is formed with a plywood or plastar board, the base material is applied to construction. In this case, the construction requires an inconvenient process, and costs a lot of time and money. Therefore, as illustrated in FIG. 12, an assistant adhesive such as primer is applied to the rear surface of the hot melt-type natural veneer or the front surface of the base material.

However, there has been a need for a structure which is formed of a flame retardant material without using an adhesive, in order to prevent fire.

The present disclosure relates to an interior material for wall and ceiling, which is manufactured by forming various natural patterns on a metal plate such as aluminum, brass, pure copper, nickel or phosphor bronze, and performing a subsequent surface treatment.

Furthermore, there has been a need for an interior material attachment structure which can be manufactured at low cost while increasing the efficiency of the work.

DISCLOSURE

Technical Problem

Various embodiments are directed to an interior material attachment structure which has an incombustible property and can be manufactured at low cost, and through which a metal plate such as aluminum, brass, pure copper, nickel or phosphor bronze is applied as an interior material.

Various embodiments are directed to a one touch-type interior material attachment structure capable of increasing the efficiency of a work.

Various embodiments are directed to an interior material attachment structure which is installed on a flat wall surface through bolts, and onto which a metal interior material such as aluminum is assembled, thereby minimizing a construction cost and maintaining a quality such as flatness.

Various embodiments are directed to an interior material attachment structure which can dramatically improve an interior environment by removing a harmful adhesive or reducing the number of construction processes.

Various embodiments are directed to an interior material attachment structure which can simplify a construction process to improve market competitiveness during a metal interior material production process.

Since the unit interior material attachment structure is formed to have a small unit size, a finish work can be ended within a short time, when a corner or edge part is finished. Therefore, it is possible to increase the efficiency of the work.

Technical Solution

For achieving the objects, the present disclosure has the following configurations.

In an embodiment, an interior material attachment structure with wall attachment part bolt grooves may include: binding protrusions formed at an outermost part of the interior material attachment structure in order to attach a metal interior material; and connection part grooves formed adjacent to the binding protrusions in order to connect a plurality of interior material attachment structures to each other.

The interior material attachment structure may further include a connector bound to the connection part groove in order to connect the plurality of interior material attachment structures.

The interior material attachment structure may have the binding protrusions formed on left and right sides of the connection part grooves.

In order to reliably construct the connection part grooves, the connection part grooves may be connected in a grid shape at inner surfaces of openings of the connection part grooves.

The interior material attachment structure may be formed in a rectangular shape, and the binding protrusions may be formed on an outer surface of the rectangular interior material attachment structure so as to be located on one side of neighboring sides at a corner of the rectangular interior material attachment structure.

Two binding protrusions may be formed on each side of the rectangular shape, wherein one binding protrusion is disposed close to a corner on one side of two sides abutting on the corner, and another of the binding protrusions is disposed relatively remote from the corner on another side.

When the interior material attachment structure is manufactured, four unit interior material attachment structures may be manufactured at a time.

In order to attach the interior material attachment structure to a wall surface, the four unit interior material attachment structures may be connected to each other through a connector.

The connector may have a binding step part to form an insertion space of the metal interior material.

The connector may include a first connection part, a connection part arm with the binding step part, and a second connection part, wherein the first connection part is coupled to the connection part grooves of the interior material attachment structures, the second connection part is bound to connection part grooves of neighboring the interior material attachment structures so as to connect a unit interior material attachment structures, and the binding step part is passed through a connection part hole formed in the metal interior material when coupled to the interior material attachment structure.

A gap between a unit interior material attachment structure and another unit interior material attachment structure adjacent thereto may be larger than the thickness of the metal interior material.

The binding protrusions may have a binding retreat space formed on the opposite side of the binding protrusion, in order to secure a retreat space when coupled to the metal interior material.

In an embodiment, there is provided a metal interior material attached to an interior material attachment structure having wall attachment part bolt grooves. The metal interior material may include: binding protrusions formed at an outermost part of the interior material attachment structure in order to attach the metal interior material; connection part grooves formed adjacent to the binding protrusions in order to connect the plurality of interior material attachment structures; binding protrusion holes of the metal interior material, to which the binding protrusions are bound, respectively; and a connection part hole of the metal interior material, corresponding to a binding step part of a connector inserted into the connection part grooves.

Two binding protrusion holes may be formed on the left and right sides of the connection part hole, respectively.

Effects of the Invention

According to the first effect, the interior material attachment structure can be manufactured to install the metal interior material in a one-touch manner, thereby improving the efficiency of work.

According to the second effect, the interior material attachment structure is installed on a flat wall surface through bolts, and the metal interior material such as aluminum is assembled onto the interior material attachment structure, which makes it possible to minimize a construction cost and to maintain a quality such as flatness.

According to the third effect, the interior material attachment structure can dramatically improve an interior environment by removing a harmful adhesive or reducing the number of construction processes.

According to the fourth effect, the construction process can be simplified to improve market competitiveness during a metal interior material production process.

According to the fifth effect, the metal interior material is used and thus serves as a flame retardant material or non-combustible material.

According to the sixth effect, since the unit interior material attachment structure is formed to have a small unit size, a finishing work can be ended within a short time, when a corner or edge part is finished. Therefore, it is possible to increase the efficiency of the work.

BEST MODE

The best mode for carrying out the present disclosure will be described with reference to FIGS. 1 to 6.

Figure 1:
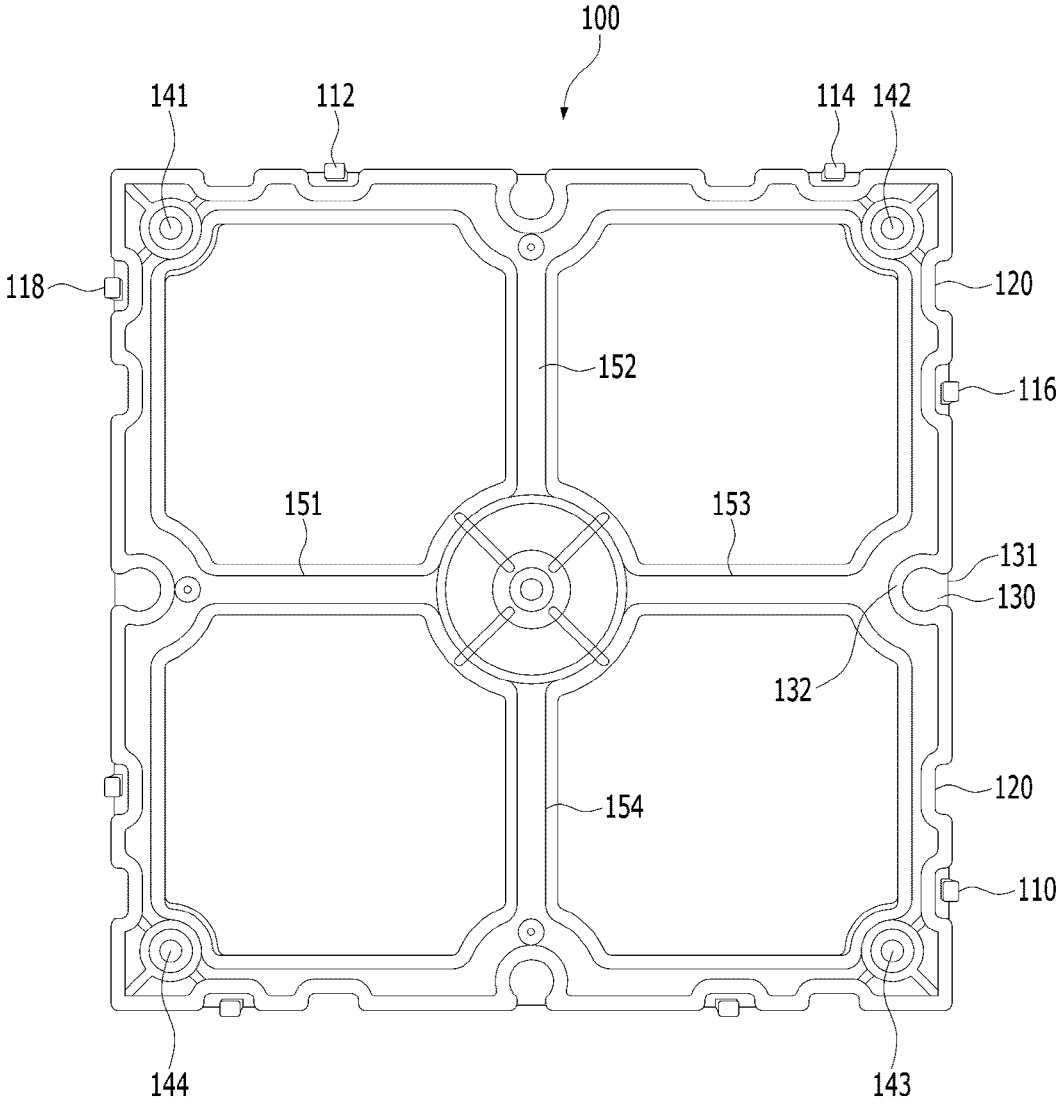
FIG. 1 is a diagram illustrating a unit interior material attachment structure.

Referring to FIG. 1, a unit interior material attachment structure 100 will be described.

The unit interior material attachment structure 100 having wall attachment part bolt grooves 141 to 144 includes: binding protrusions 110, 112, 114, 116 and 118 formed at an outermost part of the interior material attachment structure 100 in order to attach a metal interior material; and connection part grooves 130 formed adjacent to the binding protrusions 110 in order to connect a plurality of interior material attachment structures to each other.

The interior material attachment structure 100 has the binding protrusions 110 formed on left and right sides of the connection part grooves 130.

In order to reliably construct the connection part grooves 130, the connection part grooves 130 are connected in a grid shape at the rear surfaces 132 of the connection part grooves 130.

When a connector 300 is connected through the connection part grooves 130 so as to bind neighboring the interior material attachment structures to left and right sides of the connector 300, a predetermined force is required, and ribs 151 to 154 are constructed to reliably maintain the interior material attachment structure which is a plastic injection molded product.

In the present disclosure, the plastic material is used for the interior material attachment structure. However, any materials may be used.

The interior material attachment structure is formed in a rectangular shape, and the binding protrusions 110 are formed on an outer surface of the rectangular interior material attachment structure.

Each of the binding protrusions is formed on one side of neighboring sides at a corner of the rectangular interior material attachment structure.

That is, the interior material attachment structure has a structure in which two binding protrusions are located on each side of the rectangular shape. For example, as illustrated in FIG. 1, one of the binding protrusions 118 is disposed close to a corner of the wall attachment part bolt grooves 141 on one side of two sides, and the one of the binding protrusions 112 is disposed relatively remote from the corner on another side of the two sides.

According to such a structure, the interior material attachment structure can be coupled to a metal interior material even though the interior material attachment structure is coupled in any directions, which makes it possible to maximize the efficiency of the work.

The wall attachment part bolt grooves 141 to 144 are formed in the interior material attachment structure in order to attach the metal interior material to a wall.

Figure 2:
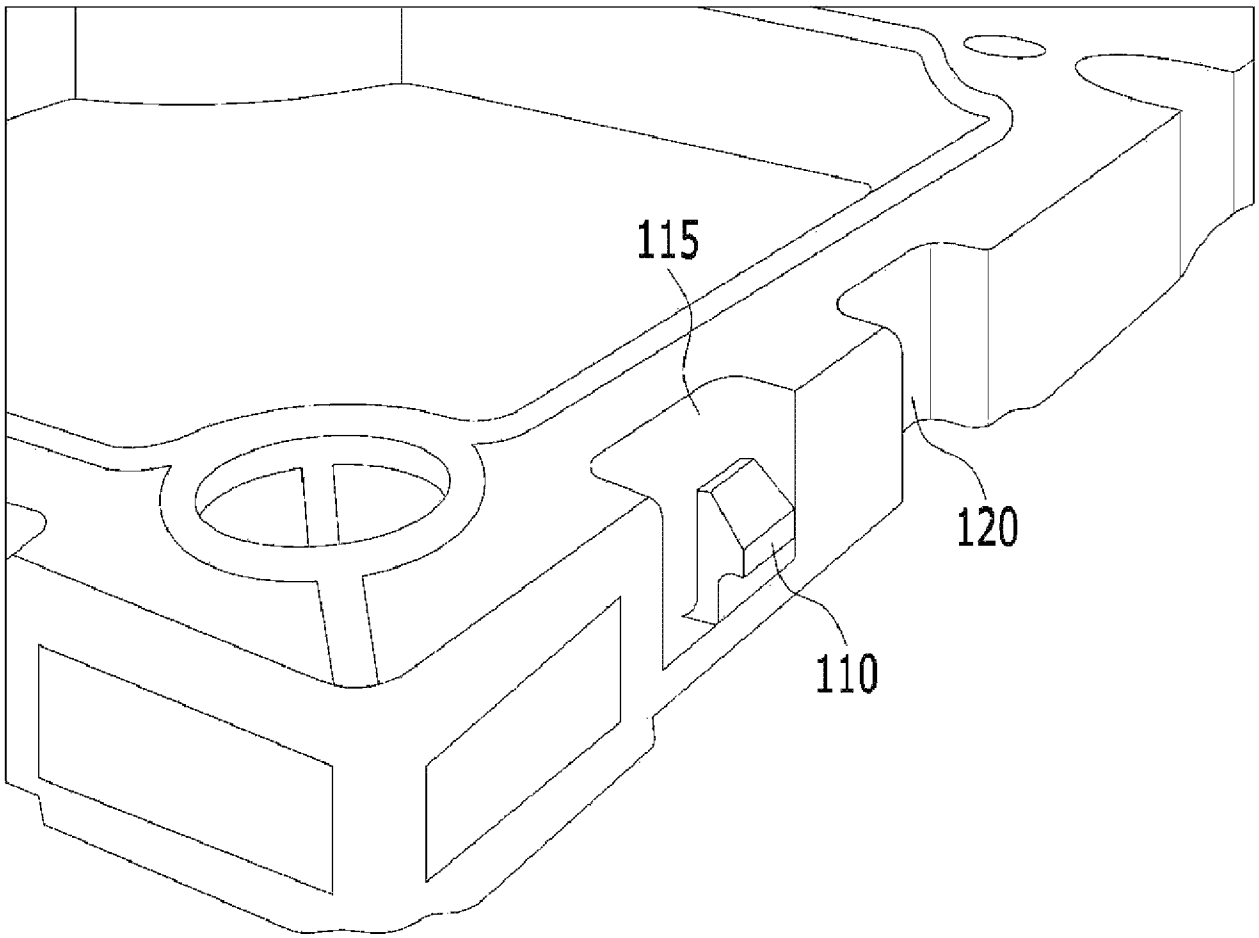
FIG. 2 is a diagram illustrating a binding protrusion.

As illustrated in FIG. 2, a binding retreat space 115 is formed at the rear surface of the binding protrusions 110. Thus, when bound to the metal interior material, the interior material attachment structure may be reliably bound through the binding retreat space.

Figure 3:
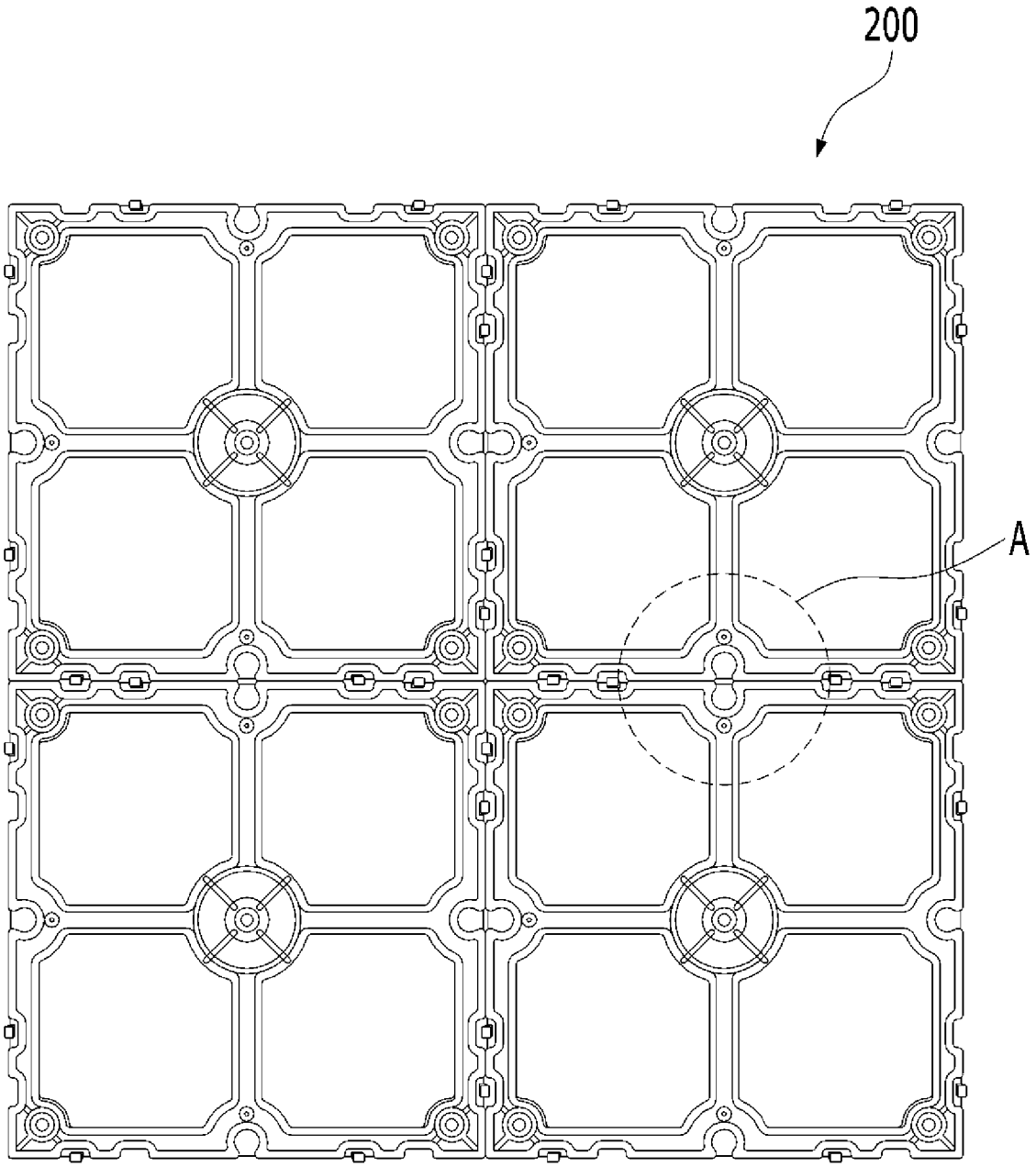
FIG. 3 is a diagram illustrating a structure obtained by connecting a plurality of unit interior material attachment structures to each other, wherein the unit interior material attachment structures are connected at a time during injection molding.
Figure 4:
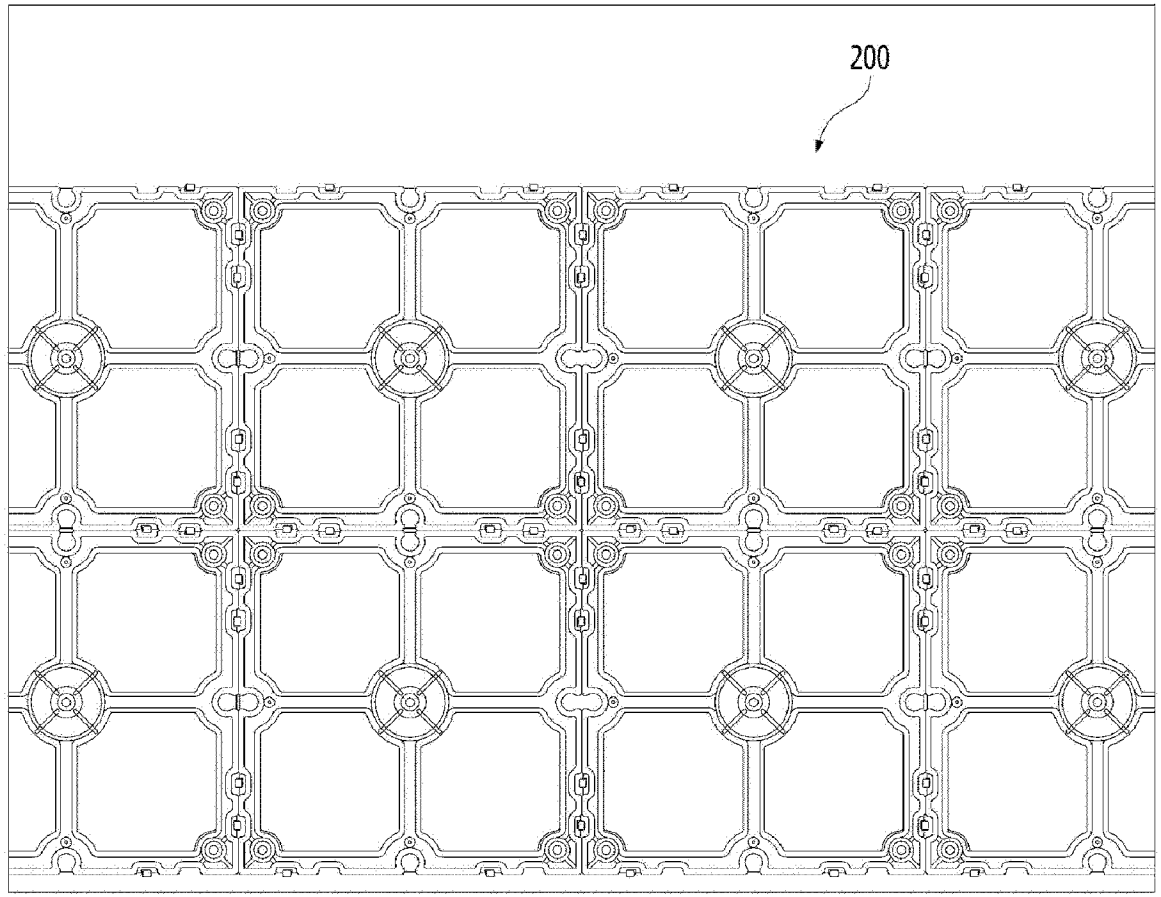
FIG. 4 is a diagram illustrating a structure obtained by connecting the structures of FIG. 3 in a side-to-side direction.

Referring to FIGS. 3 and 4, the interior material attachment structure will be described as follows.

In the present disclosure, the interior material attachment structure is manufactured in a square shape, and the unit interior material attachment structure is formed to have a size of 15 cm.

If necessary, the interior material attachment structure may have various sizes.

FIG. 3 illustrates that four unit interior material attachment structures are manufactured at once when the unit interior material attachment structures are manufactured as plastic injection molded products. The bottoms of the unit interior material attachment structures are connected to each other when the unit interior material attachment structures are manufactured as thin plastic injection molded products.

Thus, during a work, a suitably small quantity of unit interior material attachment structures can be used.

FIG. 4 will be described as follows.

In order to attach the interior material attachment structure to the wall surface, unit interior material attachment structures are connected to each other in units of four unit interior material attachment structures. FIG. 4 illustrates an interior material attachment structure 200 obtained by connecting eight interior material attachment structures through the connector.

When the unit interior material attachment structures are connected to each other through the connector in units of the four interior material attachment structures, the working time can be shortened, and the interior material attachment structure for the metal interior material may be attached to a desired wall surface. In the present embodiment, the interior material attachment structure is constructed in the units of the four unit interior material attachment structures. However, two, six, eight or more unit interior material attachment structures may be connected and injection-molded according to the necessity of working efficiency.

According to the related art, the interior material attachment structure is formed to have the same size as the interior material during work. Thus, when the work for an edge part, corner part or the like is performed, it takes a lot of time in the workplace, and it is difficult to neatly finish the interior material and the interior material attachment structure.

However, since the interior material attachment structure according to the present embodiment can be manufactured as small units, finish work for an edge or corner part is performed as easily as finish work for a wide part.

Since the unit interior material attachment structure is formed to have a small size, the finish work can be ended within a short time, when a corner or edge part is finished. Therefore, it is possible to increase the efficiency of the work.

Each of the binding protrusions 110, 112, 114, 116 and 118 has the binding retreat space 115 formed at the rear thereof, in order to secure a retreat space when the binding protrusion is coupled to an interior material 400.

Figure 5:
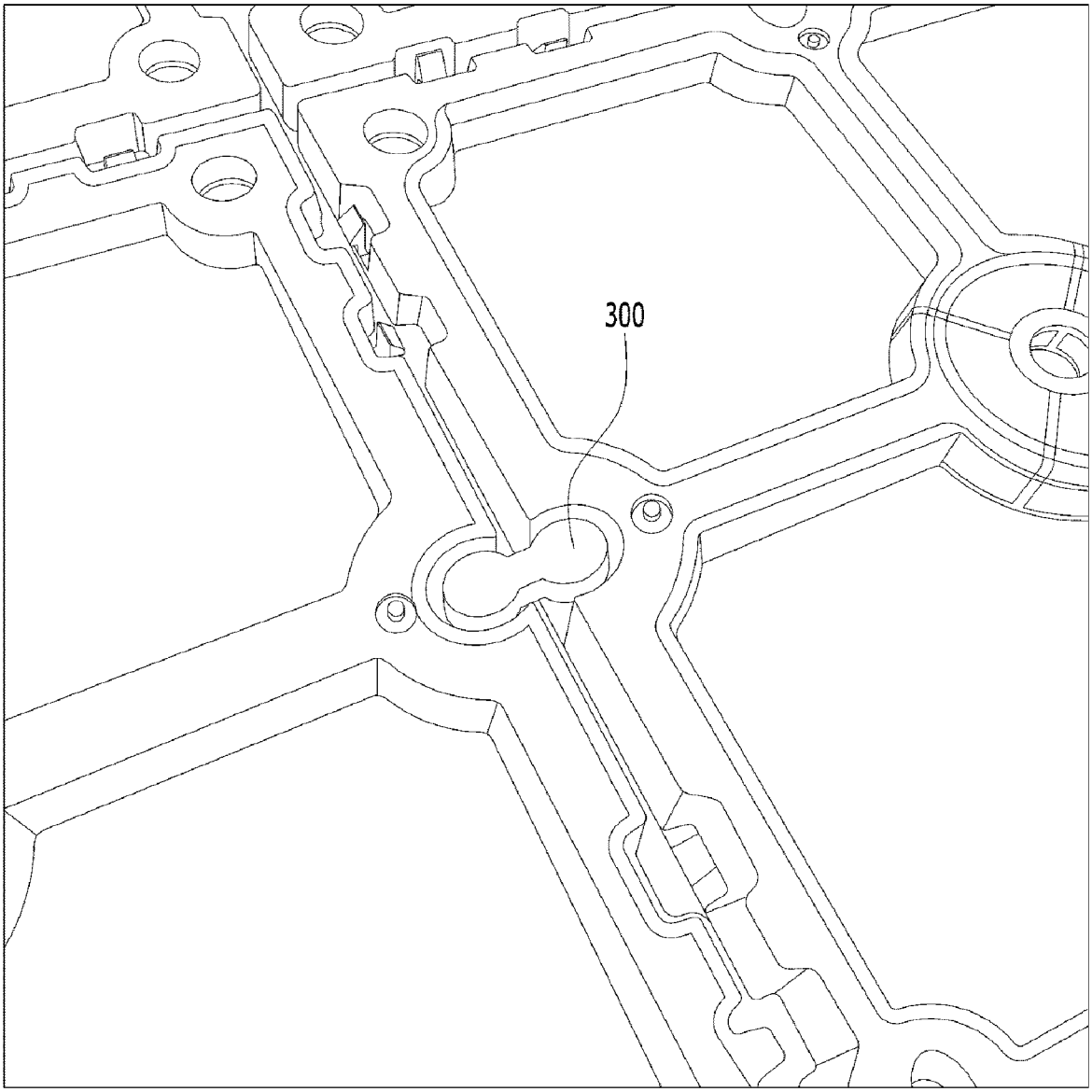
FIG. 5 is a diagram illustrating that the unit interior material attachment structures are connected to each other in the side-to-side direction through a connector.
Figure 6:
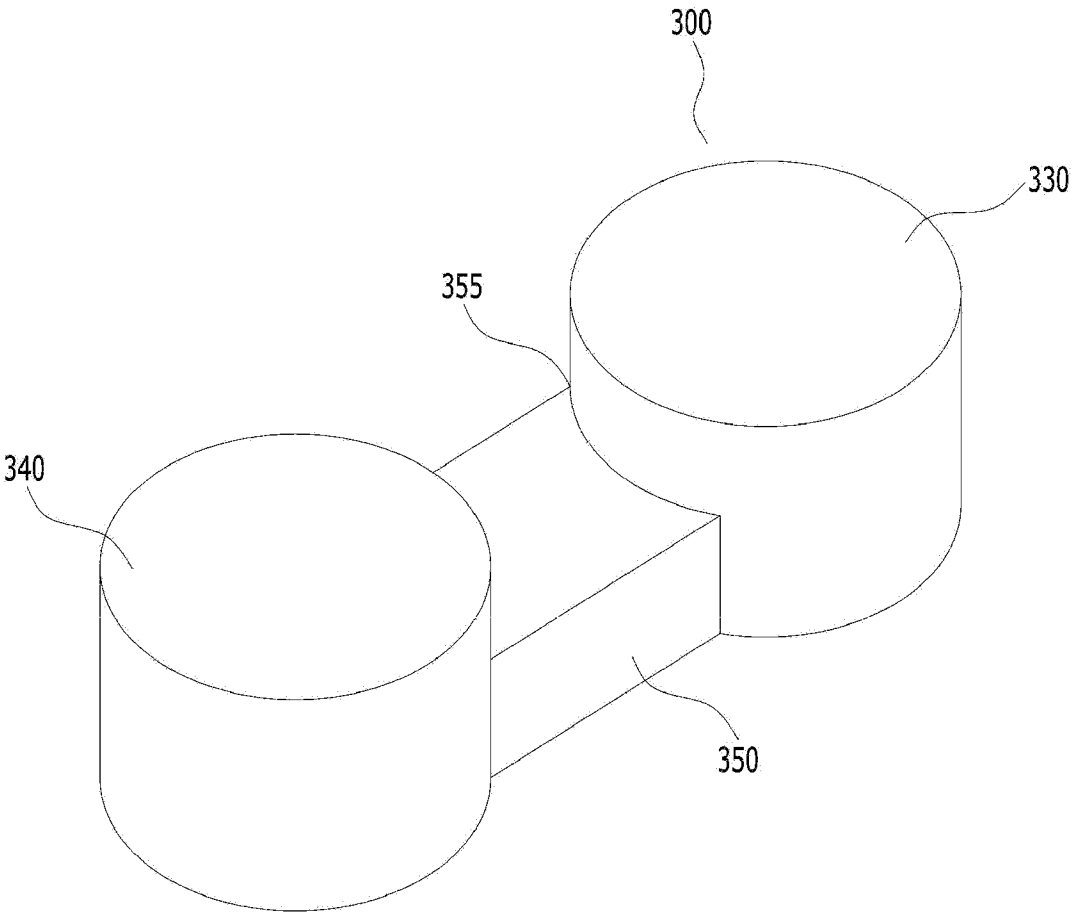
FIG. 6 is a diagram illustrating the structure of the connector.

FIGS. 5 and 6 illustrate a connection method between adjacent interior material attachment structures.

The connector for the interior material attachment structure has a binding step part 355, and is configured to secure a space such that the connector is reliably seated in a connection part hole 430 formed through a bent portion of a side surface of the metal interior material.

In order to connect four interior material attachment structures or plural sets of four interior material attachment structures, the connector 300 is used.

The connector 300 includes a first connection part 330, a connection part arm 350 having the binding step part 355, and a second connection part 340. The first connection part 330 is coupled to the connection part groove 130 of the interior material attachment structure. The second connection part 340 is bound to the connection part grooves 130 of the neighboring interior material attachment structures 100 so as to connect the unit interior material attachment structures. The binding step part 355 is passed through the connection part hole 430 formed in the metal interior material 400 when coupled to the interior material attachment structure 100.

In order to connect the plurality of interior material attachment structures 100, the connector 300 is bound to the connection part groove 130.

Between the unit interior material attachment structure 100 and another unit interior material attachment structure adjacent thereto, a gap is formed, which is twice larger than the thickness of the interior material.

For example, the thickness of the metal interior material is 0.5 mm. Since two metal interior materials are connected to the interior material attachment structure, a gap corresponding to a thickness of 1 mm needs to be provided. In order to increase the efficiency of the work or to replace a defective metal interior material 400 or a defective interior material attachment structure 100, a working space needs to be provided. Therefore, the gap between the interior material attachment structures may be set to 2 mm.

EMBODIMENTS FOR CARRYING OUT THE INVENTION

The present disclosure will be described in detail with reference to the drawings.

The terms used in this specification are defined as follows.

"Bind" is applied to a connection part between the interior material attachment structure and the metal interior material.

"Connect" is applied to a connection part between the unit interior material attachment structures.

"Hole" is applied to an opening of the metal interior material.

"Groove" is applied to an opening of the interior material attachment structure.

Referring to FIG. 1, a unit interior material attachment structure 100 will be described.

The unit interior material attachment structure 100 having wall attachment part bolt grooves 141 to 144 includes: binding protrusions 110, 112, 114, 116 and 118 formed at an outermost part of the interior material attachment structure 100 in order to attach a metal interior material; and connection part grooves 130 formed adjacent to the binding protrusions 110 in order to connect a plurality of interior material attachment structures to each other.

The interior material attachment structure 100 has the binding protrusions 110 formed on left and right sides of the connection part grooves 130.

In order to reliably construct the connection part grooves 130, the connection part grooves 130 are connected in a grid shape at rear surfaces 132 of the connection part grooves 130.

When a connector 300 is connected through the connection part grooves 130 so as to bind neighboring the interior material attachment structures to left and right sides of the connector 300, a predetermined force is required, and ribs 151 to 154 are constructed to reliably maintain the interior material attachment structure which is a plastic injection molded product.

In the present disclosure, the plastic material is used for the interior material attachment structure. However, any materials may be used.

The interior material attachment structure is formed in a rectangular shape, and the binding protrusions 110 are formed on an outer surface of the rectangular interior material attachment structure.

Each of the binding protrusions is formed on one side of neighboring sides at a corner of the rectangular interior material attachment structure.

That is, the interior material attachment structure has a structure in which two binding protrusions are located on each side of the rectangular shape. For example, as illustrated in FIG. 1, one of the binding protrusions 118 is disposed close to a corner of the wall attachment part bolt groove 141 on one side of two sides, and another of the binding protrusions 112 is disposed relatively remote from the corner on another side of the two sides.

According to such a structure, the interior material attachment structure can be coupled to a metal interior material even though the interior material attachment structure is coupled in any directions, which makes it possible to maximize the efficiency of the work.

The wall attachment part bolt grooves 141 to 144 are formed in the interior material attachment structure in order to attach the metal interior material to a wall.

As illustrated in FIG. 2, a binding retreat space 115 is formed at the rear surface of the binding protrusion 110.

Thus, when bound to the metal interior material, the interior material attachment structure may be reliably bound through the binding retreat space.

Referring to FIGS. 3 and 4, the interior material attachment structure will be described as follows.

In the present disclosure, the interior material attachment structure is manufactured in a square shape, and the unit interior material attachment structure is formed to have a size of 15 cm.

If necessary, the interior material attachment structure may have various sizes.

FIG. 3 illustrates that four unit interior material attachment structures are manufactured at a time when the unit interior material attachment structures are manufactured as plastic injection molded products. The bottoms of the unit interior material attachment structures are connected to each other when the unit interior material attachment structures are manufactured as thin plastic injection molded products.

Thus, during a work, a suitably small quantity of unit interior material attachment structures can be used.

FIG. 4 will be described as follows.

In order to attach the interior material attachment structure to the wall surface, unit interior material attachment structures are connected to each other in units of the four unit interior material attachment structures. FIG. 4 illustrates an interior material attachment structure 200 obtained by connecting eight interior material attachment structures through the connector.

When the unit interior material attachment structures are connected to each other through the connector in units of four interior material attachment structures, the working time can be shortened, and the interior material attachment structure for the metal interior material may be attached to a desired wall surface. In the present embodiment, the interior material attachment structure is constructed in the units of the four unit interior material attachment structures. However, two, six, eight or more unit interior material attachment structures may be connected and injection-molded according to the necessity of the working efficiency.

According to the related art, the interior material attachment structure is formed to have the same size as the interior material during work. Thus, when the work for an edge part, a corner part or the like is performed, it takes a lot of time in the workplace, and it is difficult to neatly finish the interior material and the interior material attachment structure.

However, since the interior material attachment structure according to the present embodiment can be manufactured as small units, finish work for an edge part or a corner part is performed as easily as finish work for a wide part.

Since the unit interior material attachment structure is formed to have a small unit size, the finish work can be ended within a short time, when a corner or edge part is finished. Therefore, it is possible to increase the efficiency of the work.

Each of the binding protrusions 110, 112, 114, 116 and 118 has the binding retreat space 115 formed at the rear thereof, in order to secure a retreat space when the binding protrusion is coupled to an interior material 400.

FIGS. 5 and 6 illustrate a connection method between adjacent interior material attachment structures.

The connector for the interior material attachment structure has a binding step part 355, and is configured to secure a space such that the connector is reliably seated in a connection part hole 430 formed through a bent portion of a side surface of the metal interior material.

In order to connect four interior material attachment structures or plural sets of four interior material attachment structures, the connector 300 is used.

The connector 300 includes a first connection part 330, a connection part arm 350 having the binding step part 355, and a second connection part 340. The first connection part 330 is coupled to the connection part grooves 130 of the interior material attachment structure. The second connection part 340 is bound to the connection part grooves 130 of the neighboring interior material attachment structures 100 so as to connect the unit interior material attachment structures. The binding step part 355 is passed through the connection part hole 430 formed in the metal interior material 400 when coupled to the interior material attachment structure 100.

In order to connect the plurality of interior material attachment structures 100, the connector 300 is bound to the connection part grooves 130.

Between the unit interior material attachment structure 100 and another unit interior material attachment structure adjacent thereto, a gap is formed, which is twice larger than the thickness of the interior material.

For example, the thickness of the metal interior material is 0.5 mm. Since two metal interior materials are connected to the interior material attachment structure, a gap corresponding to a thickness of 1 mm needs to be provided. In order to increase the efficiency of the work or to replace a defective metal interior material 400 or a defective interior material attachment structure 100, a working space needs to be provided. Therefore, the gap between the interior material attachment structures may be set to 2 mm.

Figure 7:
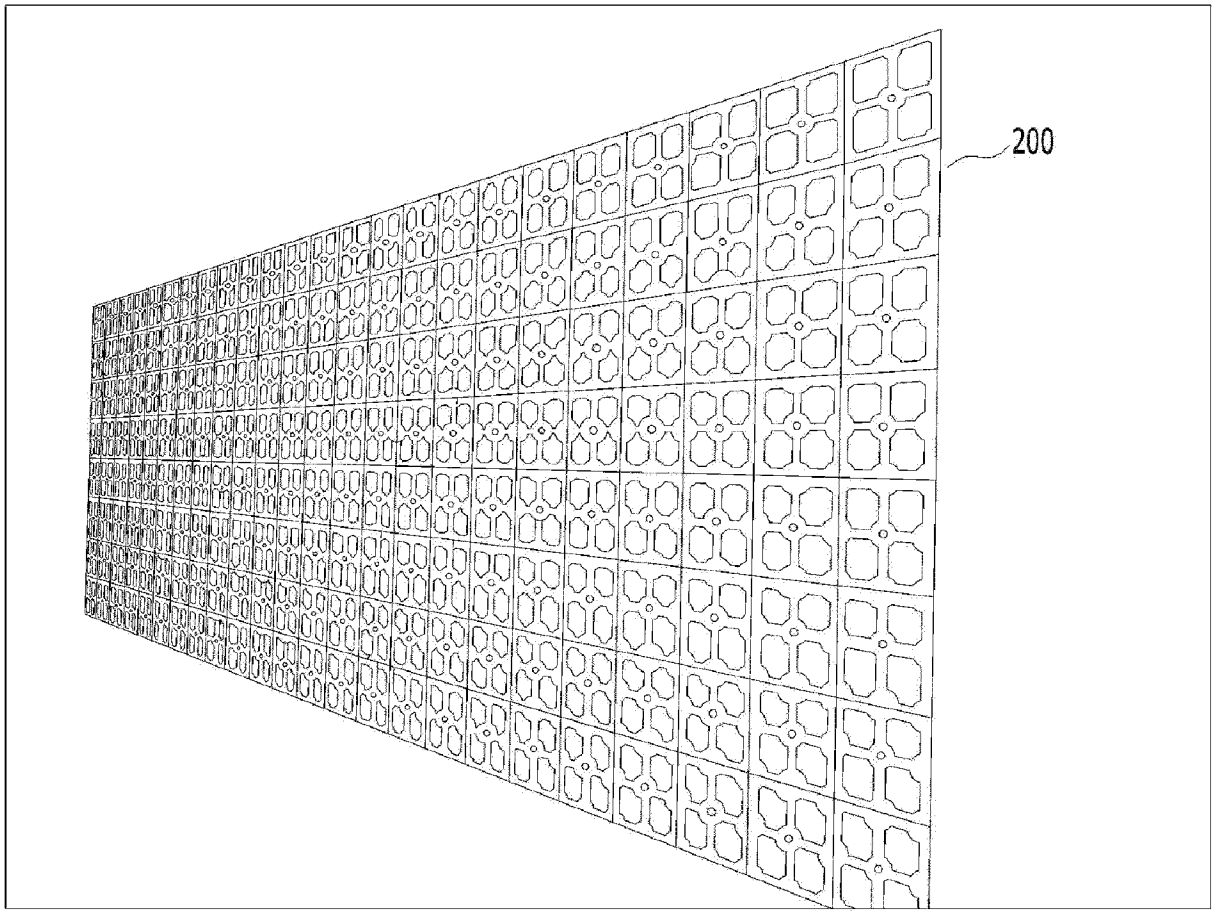
FIG. 7 is a diagram illustrating that the interior material attachment structure is attached to a wall surface.

FIG. 7 illustrates that the interior material attachment structure is attached to a wall surface to which the metal interior material is to be attached.

Figure 8:
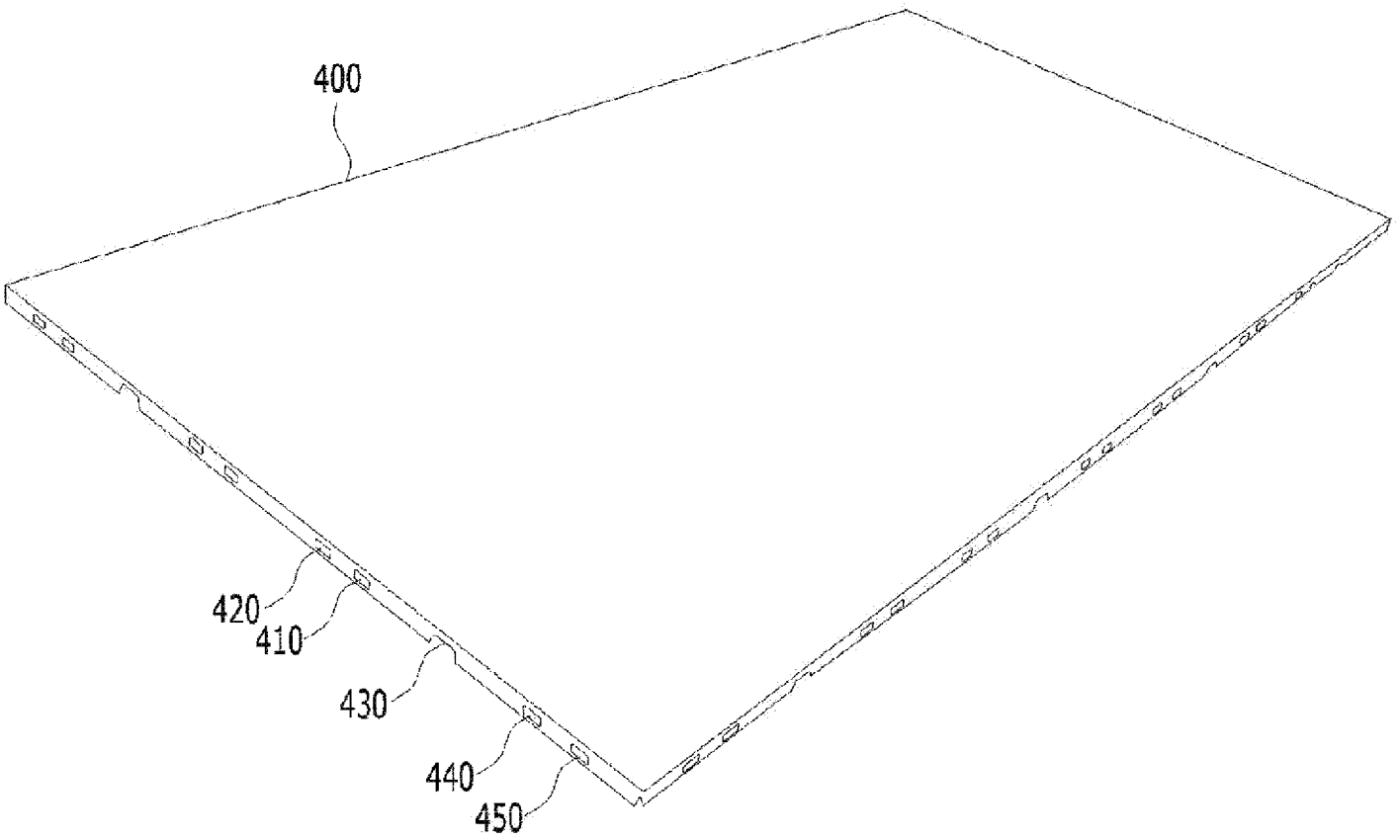
FIG. 8 is a diagram illustrating the structure of a metal interior material.

FIG. 8 illustrates the metal interior material attached to the interior material attachment structure.

A metal interior material 400 attached to a metal interior material attachment structure having wall attachment part bolt grooves 141 to 144 includes: binding protrusions 110, 112, 114, 116 and 118 formed at an outermost part of the interior material attachment structure 100 in order to attach the metal interior material; connection part grooves 130 formed adjacent to the binding protrusions in order to connect a plurality of metal interior material attachment structures to each other; binding protrusion holes 410, 420, 440 and 450 of the metal interior material, which are bound to the binding protrusions; and connection part holes 430 of the metal interior material, corresponding to a binding step part 355 of a connector inserted into the connection part groove.

The binding protrusion holes 410, 420, 440 and 450 may be formed so that two binding protrusion holes are located on the left and right sides of the connection part hole 430, respectively.

Figure 9:
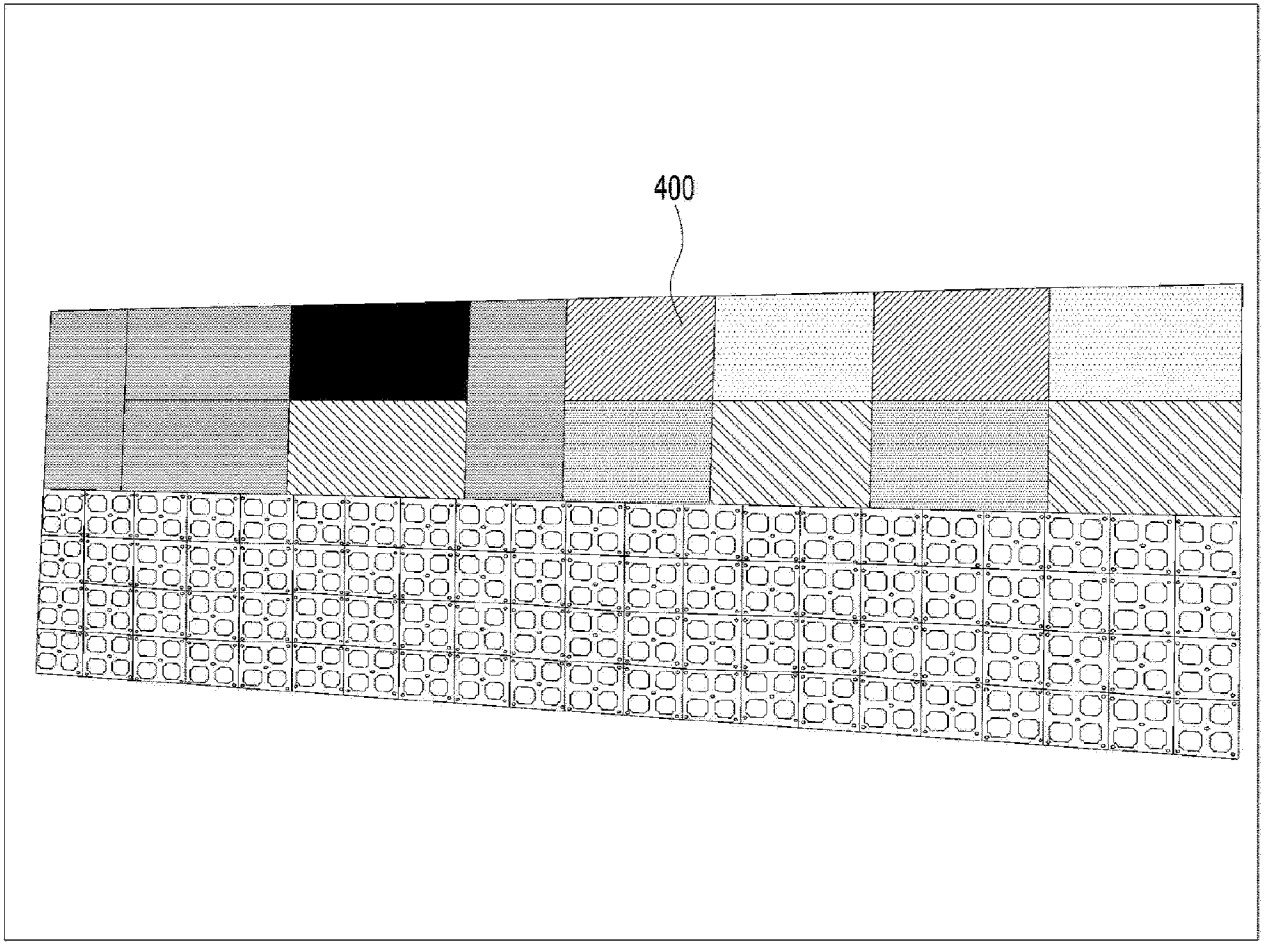
FIG. 9 is a diagram illustrating a working process of attaching a metal interior material to the interior material attachment structure of FIG. 7.
Figure 10:
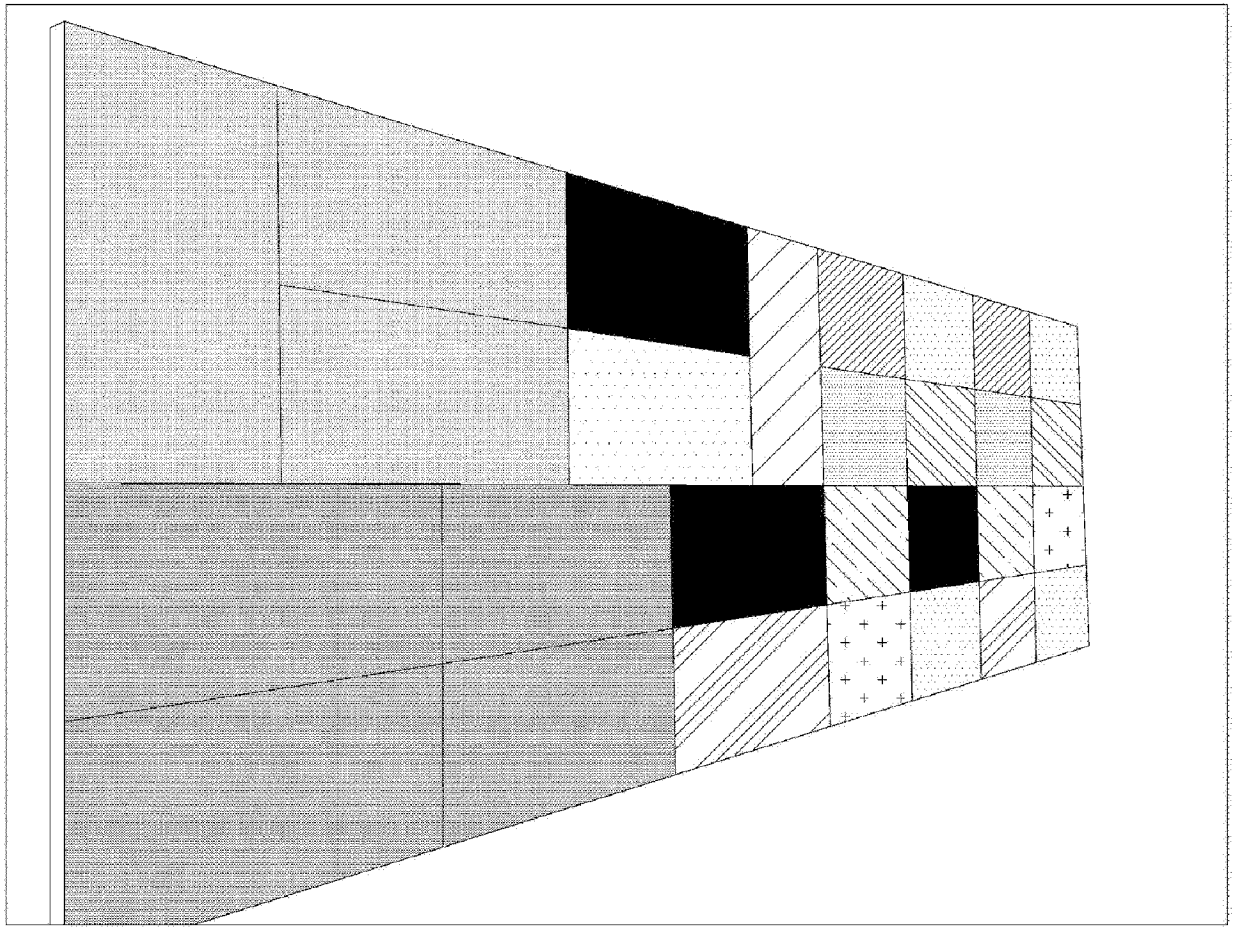
FIG. 10 is a diagram illustrating that the metal interior material is attached to the entire surface of a wall, on which the interior material attachment structure of FIG. 9 is formed.
Figure 11:
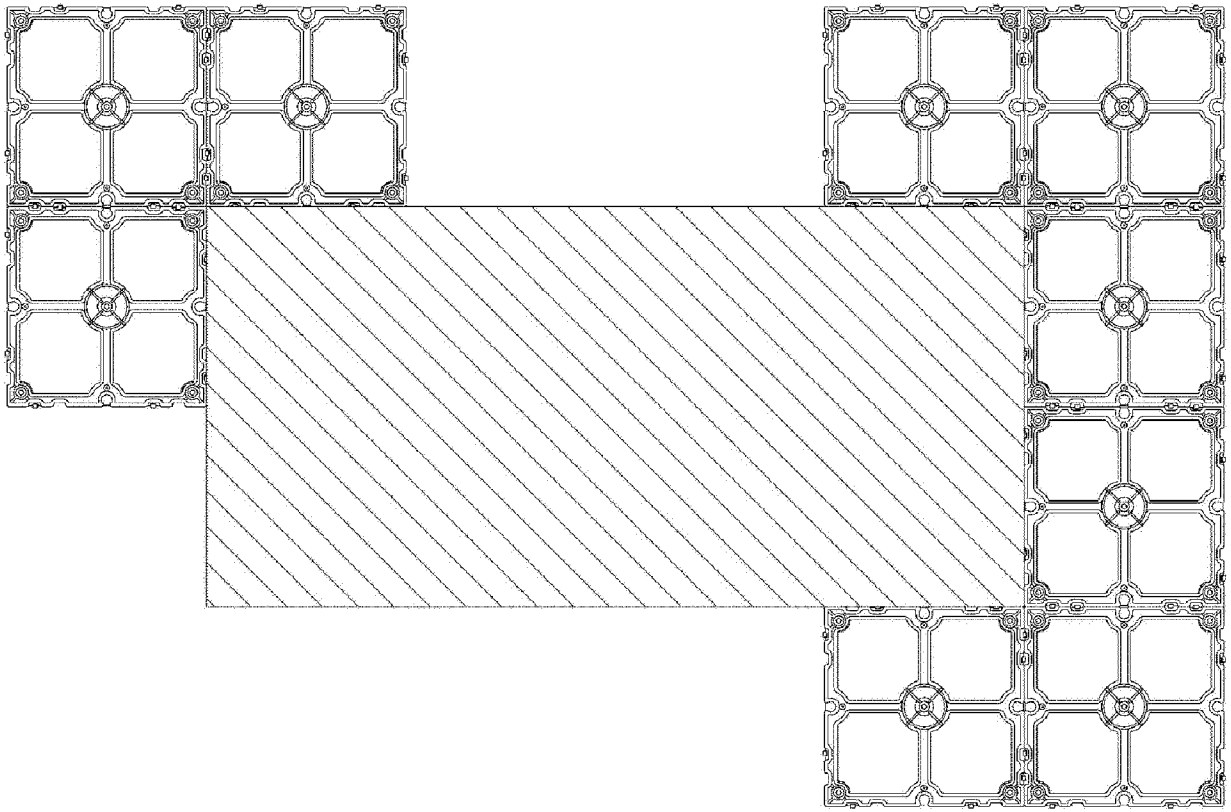
FIG. 11 is a diagram illustrating that the interior material attachment structures are formed on parts of a wall surface, and the metal interior material is attached to the wall surface.
Figure 12:
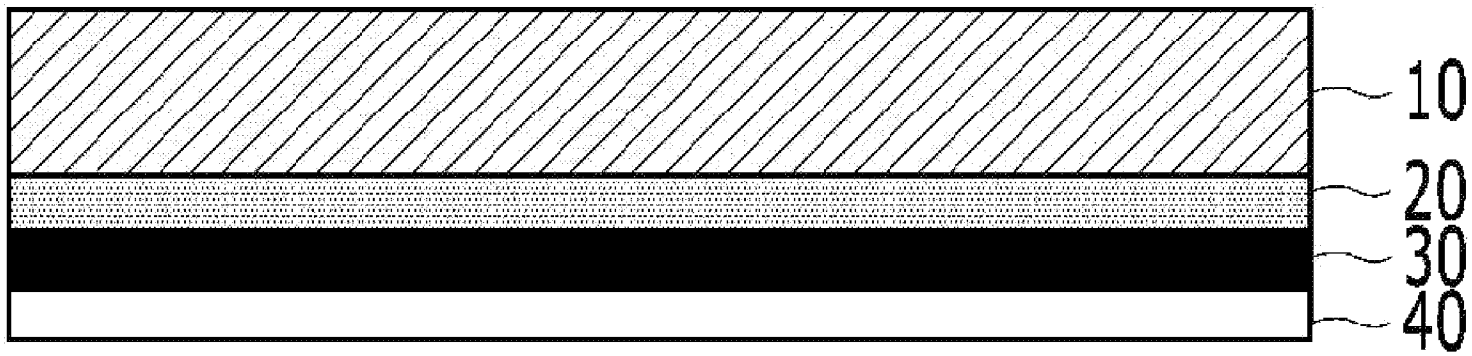
FIG. 12 is a diagram illustrating a structure according to the related art.

FIGS. 9, 10 and 11 will be described as follows.

FIG. 9 illustrates a process of attaching the metal interior material.

FIG. 10 illustrates that the metal interior material is completely attached.

FIG. 11 illustrates that the interior material attachment structures are not successively arranged, but coupled to parts of the metal interior material.

For such an arrangement, the binding protrusions of the metal interior material attachment structure are formed at a corner so as not to be symmetrical with each other, and the grooves of the metal interior material in FIG. 8 are formed with margins.

The terms used in this specification and claims should not be limited to typical or dictionary definitions, but analyzed as definitions and concepts which coincide with the technical idea of the present disclosure, based on the principle that the inventor can properly define the concepts of the terms in order to describe his or her invention in the best way.

Therefore, embodiments described in this specification and configurations illustrated in the drawings are only preferred embodiments of the present disclosure and do not represent all of the technical idea of the present disclosure. Thus, various equivalent and modifications capable of replacing the embodiments can be provided at the point of time that the present application is filed.

INDUSTRIAL APPLICABILITY

The present disclosure provides a metal interior material serving as a flame retardant material or incombustible material.

Furthermore, the interior material attachment structure is manufactured to install the metal interior material in a one-touch manner, thereby increasing the efficiency of the work. The construction process can be simplified to improve the market competitiveness of the metal interior material such as aluminum during a process of mass-producing metal interior material products.

Since the unit interior material attachment structure is formed to have a small unit size, the finish work can be ended within a short time, when a corner or edge part is finished, which makes it possible to increase the economic feasibility of the work. Therefore, the present disclosure has industrial applicability.

The invention claimed is:

1. An interior material attachment structure with wall attachment part bolt grooves, comprising:

binding protrusions formed at an outermost part of the interior material attachment structure in order to attach a metal interior material;

connection part grooves, each formed adjacent to the binding protrusions in order to connect the interior material attachment structure to an adjacent interior material attachment structure; and a connector bound to each connection part groove in order to connect the interior material attachment structure and the adjacent interior material attachment structure, wherein the binding protrusions are formed on left and right sides of each connection part groove, and wherein the binding protrusions hive a binding retreat space formed on an opposite side of the binding protrusions in order to secure a retreat space when coupled to the metal interior material.

2. The interior material attachment structure of claim 1, wherein in order to reliably construct the connection part grooves, the connection part grooves are connected by ribs at inner surfaces of openings of the connection part grooves.

3. The interior material attachment structure of claim 1, wherein the interior material attachment structure is formed in a rectangular shape, and the binding protrusions are formed on an outer surface of the rectangular interior material attachment structure so as to be located on one side of neighboring sides at a corner of the rectangular interior material attachment structure.

4. The interior material attachment structure of claim 3, wherein two binding protrusions of said binding protrusions are formed near each respective corner on of the rectangular shape, wherein one of the two binding protrusions is disposed on one of the neighboring sides and at a given distance from the respective corner, and the other of the two binding protrusions is disposed on the other of the two neighboring sides and at farther than the given distance from the respective corner.

5. The interior material attachment structure of claim 1, wherein when the interior material attachment structure is manufactured, four unit interior material attachment structures are manufactured at a time.

6. The interior material attachment structure of claim 5, wherein in order to attach the interior material attachment structure to a wall surface, the four unit interior material attachment structures are connected to each other through the connectors.

7. The interior material attachment structure of claim 5, wherein a gap between the interior material attachment structure and the adjacent interior material attachment structure is larger than the thickness of the metal interior material.

8. The interior material attachment structure of claim 1, wherein the connector has a binding step part to form an insertion space of the metal interior material.

9. An interior material attachment structure with wall attachment part bolt grooves, comprising:

binding protrusions formed at an outermost part of the interior material attachment structure in order to attach a metal interior material;

connection part grooves, each formed adjacent to the binding protrusions in order to connect the interior material attachment structure to adjacent interior material attachment structure; and a connector bound to each connection part groove in order to connect the interior material attachment structure and the adjacent interior material attachment structure, wherein the connector comprises a first connection part, a connection part arm with the binding step part, and a second connection part, and wherein each first connection part is coupled to one of the connection part grooves of the interior material attachment structure, each second connection part is bound to a connection part groove of the adjacent interior material attachment structure so as to connect the interior material attachment structure and the adjacent interior material structure, and the binding step part is passed through a connection part hole formed in the metal interior material when coupled to the interior material attachment structure.

10. An assembly including a metal interior material attached to an interior material attachment structure having wall attachment part bolt grooves, the interior material attachment structure comprising:

binding protrusions formed at an outermost part of the interior material attachment structure in order to attach the metal interior material; and connection part grooves, each formed adjacent to the binding protrusions in order to connect the interior material attachment structure and an adjacent interior material attachment structure, and the metal interior material comprising:

binding protrusion holes to which the binding protrusions are bound, respectively; and a connection part hole corresponding to a binding step part of a connector inserted into the connection part grooves.

11. The assembly of claim 10, wherein two binding protrusion holes are formed on the left and right sides of the connection part hole, respectively.

* * * * *